US006439383B1

(12) United States Patent
Janousek

(10) Patent No.: US 6,439,383 B1
(45) **Date of Patent: *Aug. 27, 2002**

(54) PACKAGING FOR SHIPMENT OF FIBER GLASS ROVINGS

(75) Inventor: Edward Alan Janousek, Wichita Falls, TX (US)

(73) Assignee: Saint-Gobain Vetrotex America, Inc., Wichita Falls, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 464 days.

(21) Appl. No.: 08/754,462

(22) Filed: Nov. 21, 1996

Related U.S. Application Data

(63) Continuation of application No. 08/182,955, filed on Jan. 18, 1994, now abandoned.

(51) Int. Cl.[7] ..... B65D 85/67

(52) U.S. Cl. ..... 206/394; 206/497; 206/499

(58) Field of Search ..... 206/389, 391, 206/392, 394, 397, 386, 410, 446, 497, 499, 597, 585, 586

(56) References Cited

U.S. PATENT DOCUMENTS

| | | | | | |
|---|---|---|---|---|---|
| 2,846,064 | A | * | 8/1958 | Rowe | 206/586 |
| 3,438,544 | A | * | 4/1969 | Cloyd | 206/596 |
| 3,805,473 | A | * | 4/1974 | Lidgard | 53/410 |
| 3,867,806 | A | * | 2/1975 | Lancaster, III et al. | 53/441 |
| 3,986,611 | A | * | 10/1976 | Dreher | 53/441 |
| 4,244,471 | A | * | 1/1981 | Plante | 53/139.7 |
| 4,482,054 | A | * | 11/1984 | Gardner | 206/593 |
| 4,607,476 | A | * | 8/1986 | Fulton, Jr. | 53/441 |
| 4,897,980 | A | * | 2/1990 | Geyser et al. | 53/139.7 |
| 4,919,270 | A | * | 4/1990 | Govang et al. | 206/497 |
| 4,969,307 | A | * | 11/1990 | Winans et al. | 53/410 |
| 4,998,619 | A | * | 3/1991 | Sowa et al. | 206/392 |
| 5,226,280 | A | * | 7/1993 | Scherer et al. | 53/139.7 |
| 5,551,563 | A | | 9/1996 | Allen | |

FOREIGN PATENT DOCUMENTS

| | | | | |
|---|---|---|---|---|
| FR | 2385604 | * | 12/1978 | 53/410 |
| FR | 2446238 | * | 9/1980 | 53/410 |

OTHER PUBLICATIONS

PPG IndusTries, Inc., four photos of packaging unit shown commercially about Sep. 1992.*

PPG Industries, Inc., Packing Specification No. 913.0 and five photos, Sep. 1993.*

PPG Industries, Inc., Packing Specification No. 972.0, Nov. 1992.*

PPG Industries, Inc., Packing Specification No. 972.1, Dec. 1992.*

PPG Industries, Inc., Packing Specification No. 654.2, Apr. 1993.*

Report from Paul E. Sowa of Signode Packaging SystemS regarding alternative packaging units, Jul. 1993.*

* cited by examiner

*Primary Examiner*—Luan K. Bui
(74) *Attorney, Agent, or Firm*—Duane Morris LLP

(57) ABSTRACT

A method for packaging fiber glass rovings is provided which substantially reduces the amount of material needed to securely package the rovings for shipment and/or in-process storage and handling. Also provided is a method for packaging fiber glass rovings which permits the packaging material to be reused. In a preferred embodiment the method comprises stacking fiber glass rovings on a shipping pallet; placing curved panels vertically at least at the four corners of the assembly of stacked rovings, said panels being approximately semi-cylindrical and having a height at least as great as the height of a column of stacked rovings; placing support members among the stacked rovings, said support members having a combined compressive strength sufficient to support the weight of a second pallet of stacked rovings; placing a top cap over the assembly of rovings, panels and support members; and thereafter wrapping the assembly with a stretch wrap material.

19 Claims, 4 Drawing Sheets

PACKAGING FOR SHIPMENT OF FIBER GLASS ROVINGS

This is a Continuation application of application Ser. No. 08/182,955, filed Jan. 18, 1994 now abandoned.

FIELD OF THE INVENTION

This invention relates to packaging for fiber glass rovings. More particularly, this invention describes a method of packaging fiber glass rovings for shipping or in-process handling and storage utilizing a minimal amount of packaging material which is capable of being reused.

BACKGROUND OF THE INVENTION

Fiber glass rovings are frequently used in the reinforcement of plastics and other materials. These fibers are produced by allowing molten glass to pass through small holes or nozzles located at the base of an electrically heated bushing. The glass is attenuated into continuous filaments as it passes through the holes. Once formed, the fibers are cooled with a water spray and coated with an appropriate size. The strands are then gathered and wound onto a tube to form a cake. The material is then dried by passing the cake through an appropriate drying oven. Once dried, material from several cakes is unwound and rewound to form an assembled roving.

Customers of fiber glass rovings typically demand that the material be received in undamaged condition. The nature of the fibers and the configuration of the rovings renders the material particularly susceptible to damage during shipping and handling. Furthermore, customers often demand product in which the rovings are physically connected to those of an adjacent roving within the shipping container. This interconnection of the strands from roving to roving considerably reduces the time and labor involved in processing the material for the customer.

For the past several decades, the rovings have been packaged and shipped in corrugated boxes with corrugated sleeves. These packaging materials provide stability and protection during transit. They also allow the end user to stack one pallet on top of another. Double stacking is very important to both ultimate customers and distributors of the material. Such stacking minimizes the amount of floor space necessary to store the material, allowing more room for other inventory and equipment. The present system utilizing corrugated boxes prevents the bottom pallet of rovings from becoming damaged through compression when a second pallet is placed on top of the bottom pallet.

The present system of packaging, however, utilizes a considerable amount of corrugated material. The packaging system typically contains individual sleeves for increasing stacking strength during shipping. The rovings are stacked on a shipping pallet upon which a slip sheet has been placed to prevent the rough surface of the pallet (typically wood) from abraiding or otherwise damaging the rovings. Once the rovings are stacked, corrugated panels or sleeves are placed around each column of stacked rovings. These corrugated sleeves increase the strength of the container and provide stability. Additionally, a number of support posts are located in various sleeves to further prevent crushing of the rovings when a second palletized load is stacked onto the first pallet.

A top cap (typically corrugated material) is placed over the assembly to further protect the rovings.

Over the past few years, trash disposal has become a significant problem for industries in many localities throughout the United States. Sanitary landfill restrictions have become increasingly more stringent. Both residential and industrial customers of landfills are having increasing difficulty in discarding trash. As a result, the importance of recycling has increased significantly.

In light of the foregoing, it has become apparent that the present packaging system has several drawbacks which this invention is designed to overcome. First, the amount of corrugation presently used to ship fiber glass rovings is excessive. Although some customers are recycling the corrugated materials, they are faced with having to pay a recycler to haul the material away. Additionally, several landfills in the northeastern part of the United States no longer accept any corrugation. Other landfills will accept corrugation only when a surcharge is paid.

As the foregoing indicates, there is a need for a more efficient packaging system utilizing less material and/or reusable materials. This invention reduces the amount of material utilized in packaging fiber glass rovings while at the same time providing a sturdy packaging system to enable the material to survive shipping and in-process storage and handling. Furthermore, the invention will still permit customers to double stack the pallets during storage and other handling. Finally, the present invention will permit packaging materials to be reused.

SUMMARY OF THE INVENTION

The present invention provides a package assembly for shipment and in-storage handling of rovings of material comprising a support base; plurality of generally cylindrical rovings stacked vertically upon the support base, the vertically stacked plurality of rovings having at least a first roving layer and a second roving layer defining a height and having outside comers, a plurality of curved protective panels each of which is at least the height of two roving layers, wherein the protective panels approximately conform to the exposed height of the vertically stacked plurality of rovings and being located at the outside comers of the vertically stacked plurality of rovings, and, securing means for holding the support base, rovings and protective panels together.

The present invention also provides a package assembly for shipment and in-storage handling of rovings of material consisting of a support base, a plurality of generally cylindrical rovings stacked vertically upon the support base, the vertically stacked plurality of rovings having from about one to about four roving layers defining a height and having outside comers, a plurality of curved protective panels each of which is approximately conform to the exposed height of the vertically stacked plurality of rovings and being located at the outside comers of the vertically stacked plurality of rovings, optionally, a top cap placed at the side of the vertically stacked plurality of rovings opposite the support base, and, securing means for holding the support base, rovings, protective panels together, wherein the top cap also is held by the securing means when the top cap is present.

This invention further provides a method of packaging fiber glass rovings for shipping and in-process handling and storage. The method consists of placing a slip sheet on a conventional shipping pallet made of wood or another material then stacking fiber glass rovings thereupon. In a preferred embodiment, four aligned rows of rovings each three deep are placed on the slip sheet. Additional layers of rovings are stacked on top of the bottom layer until there are four layers on the pallet each containing twelve rovings for a total of forty-eight rovings per pallet. Thereafter, curved panels are vertically positioned at the four corners of the assembly of stacked rovings to protect the columns of stacked rovings located at the four corners which are particularly susceptable to damage during shipping or other handling. In a preferred embodiment, these curved panels are slightly taller than the height of the columns of stacked rovings, are approximately semi-cylindrical and approximately conform to one-half of the circumference of a column of stacked rovings. The panels protect the stacked rovings during shipping and other handling.

Vertical support posts are also provided which, in a preferred embodiment, are slightly taller than the height of the columns of stacked rovings. An appropriate cover or top cap is placed over the rovings, panels and support posts to hold the assembly together so that a stretch wrap material can be applied and to further protect the rovings during shipping, storage and other handling. The assembled load is then wrapped with stretch wrap or another appropriate material.

BRIEF DESCRIPTION OF THE DRAWING

In FIG. 3 the top cap is removed.

DETAILED DESCRIPTION OF THE PREFERRED EMBODIMENT

A shipping container for fiber glass rovings is disclosed. FIGS. 3–6 illustrate a preferred embodiment of the invention.

Figure 1:
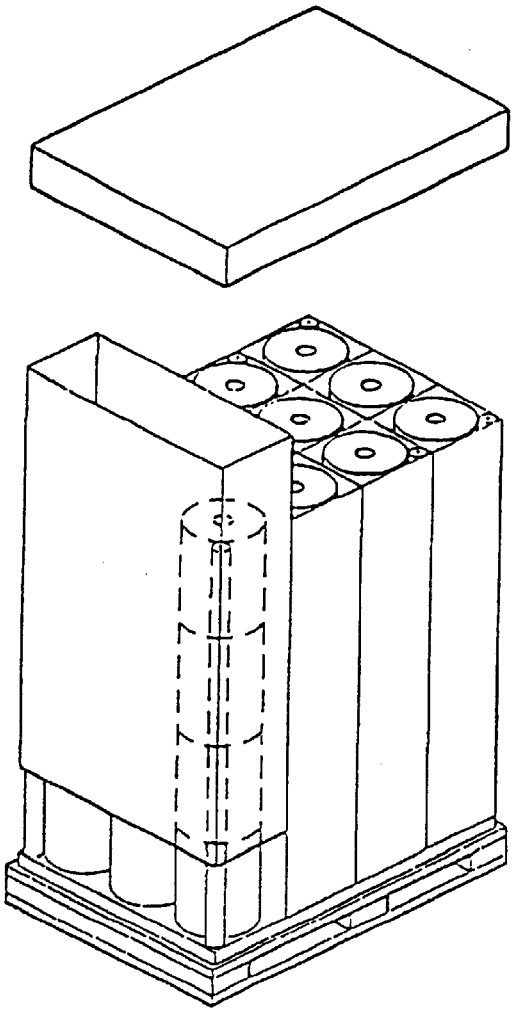
FIG. 1 PRIOR ART
FIG. 1: is a partial side and top perspective of a typical packaging assembly which has been used for the past few decades for shipping fiber glass rovings with the cover removed. The illustrated package holds forty-eight rovings.
Figure 2:
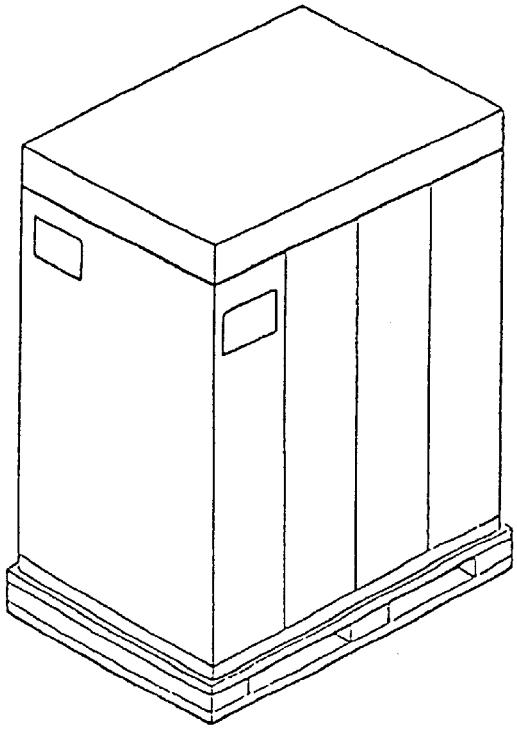
FIG. 2 PRIOR ART
FIG. 2: is a partial side and top perspective of the same packaging assembly with the cover in place.
Figure 4:
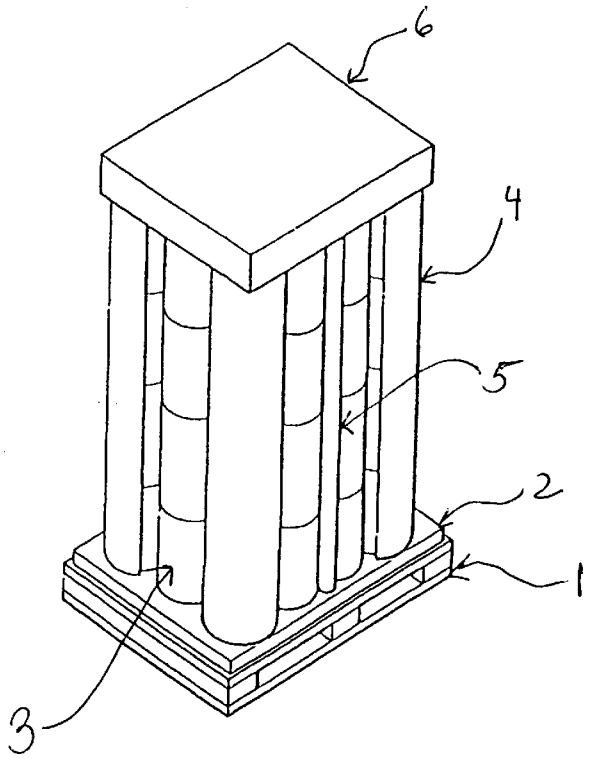
FIG. 4: is identical to FIG. 3 except that the top cap of the packaging system is in place.
Figure 3:
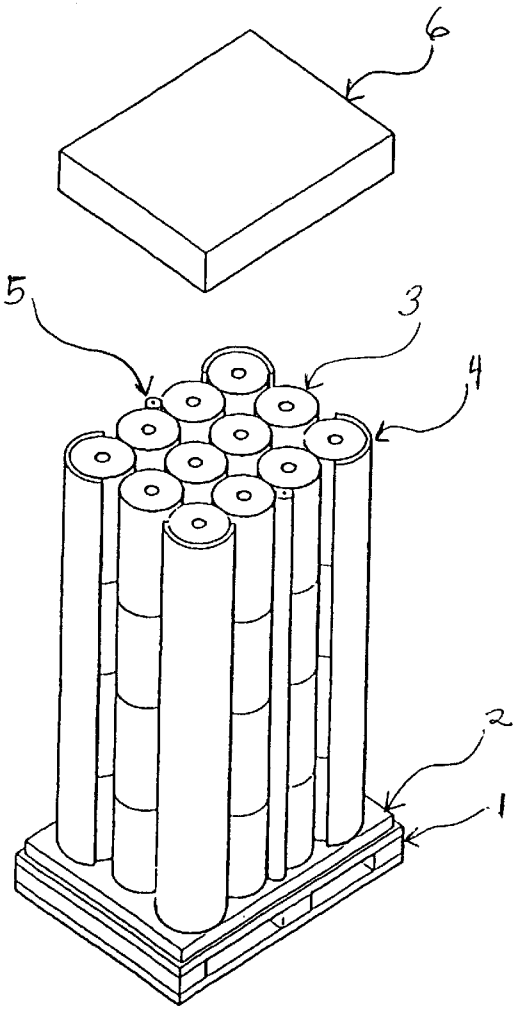
FIG. 3: is a side and top perspective of a preferred embodiment of the present invention prior to the assembly being wrapped with a stretch wrap or another appropriate material.
Figure 6:
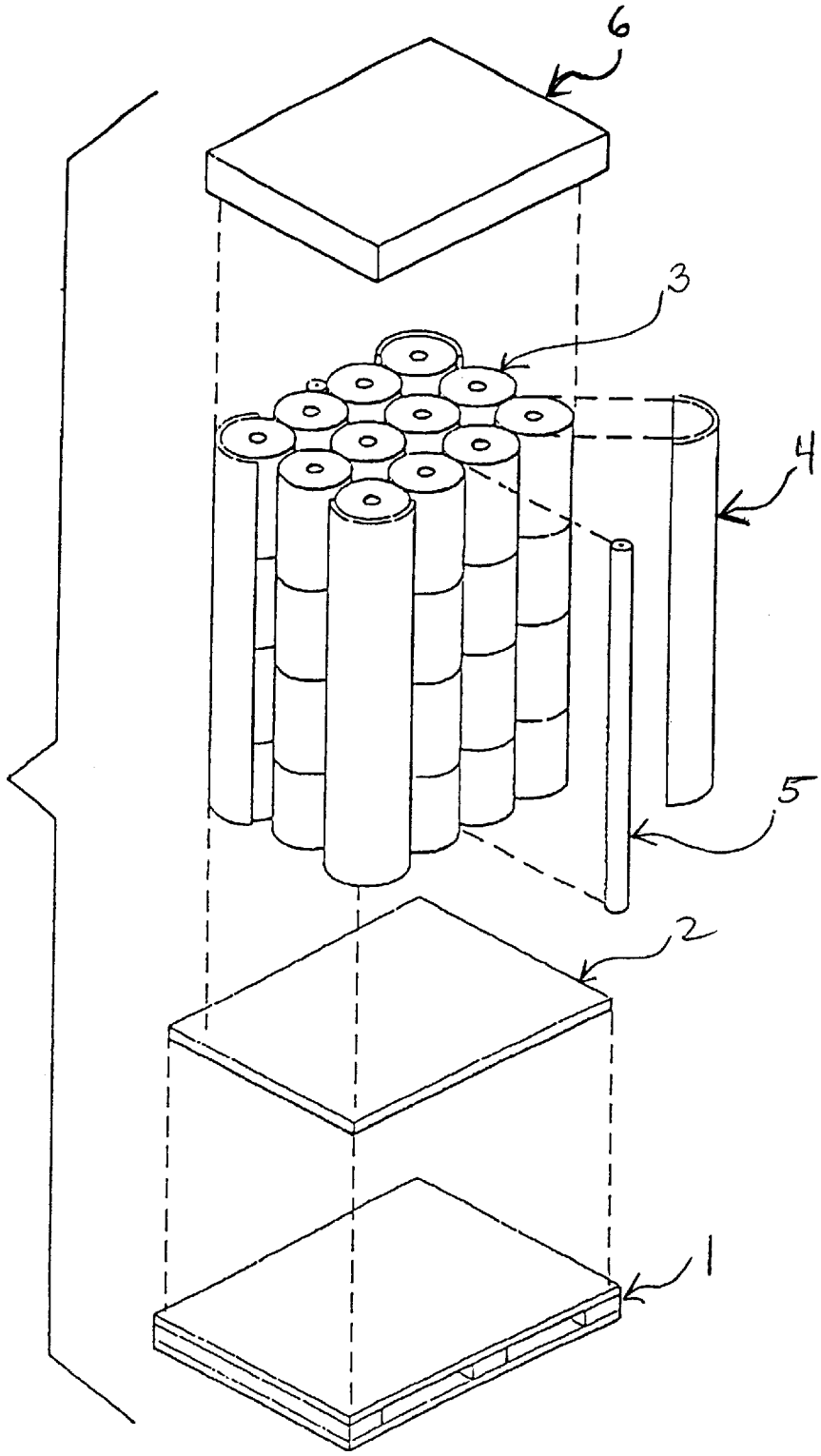
FIG. 6: is an exploded isometric or broken out side and top perspective of a preferred embodiment of the invention.

With reference to FIGS. 3, 4 and 6 a slip sheet (2) is placed on a shipping pallet (1). Thereafter, fiber glass rovings (3) are stacked on the pallet. FIGS. 3, 4, and 6 show a package containing forty-eight rovings. The invention, however, can be practiced with either a lessor or greater number of rovings being assembled in the package.

Once the rovings are stacked, curved panels, (4) are vertically situated as illustrated in FIGS. 3 through 6, to protect the columns of rovings located at the four corners of the assembled stacks of rovings. In a preferred embodiment, the panels are approximately semi-cylindrical. This provides additional protection to the corner rovings and assists in maintaining the stacked rovings in position when the assembly is ultimately secured with a stretch wrap material. The degree of curvature of the curved panels approximately conforms to the outside circumference of the rovings. It is desireable, although not required, that the curved panels fit flush against the rovings. Furthermore, it is desireable that the vertically situated curved panels are slightly taller (at least 1/16 th of an inch or more) than the height of the column of stacked rovings. In any case, the curved panels should in no event be shorter than the height of the stacked rovings in a particular column. This is to prevent a second pallet of rovings placed on top of the first pallet from compressing or otherwise damaging the material.

The curved panels can be made of any appropriate relatively rigid material including plastic, corrugated or pressed board materials, or other suitable materials. Ideally, the material should be sufficiently rigid or have a sufficient compression strength to allow stacking of a second pallet of rovings on the bottom pallet. The material can be a composite material or a reinforced composite material. Depending upon the material from which the panels are made, the panels can be returned to the roving supplier and reused.

Again, the purpose of the curved panels is to protect the columns of rovings located at the four corners not only during shipping and in-process storage and handling but also during stretch wrapping which occurs at the end of the packaging process. Additionally, the fact that the panels have a relatively high compression strength and are slightly taller in vertical height than the stacked rovings in a particular column further protects the material from damage especially when additional palletized loads are placed on top of a particular package.

Figure 5:
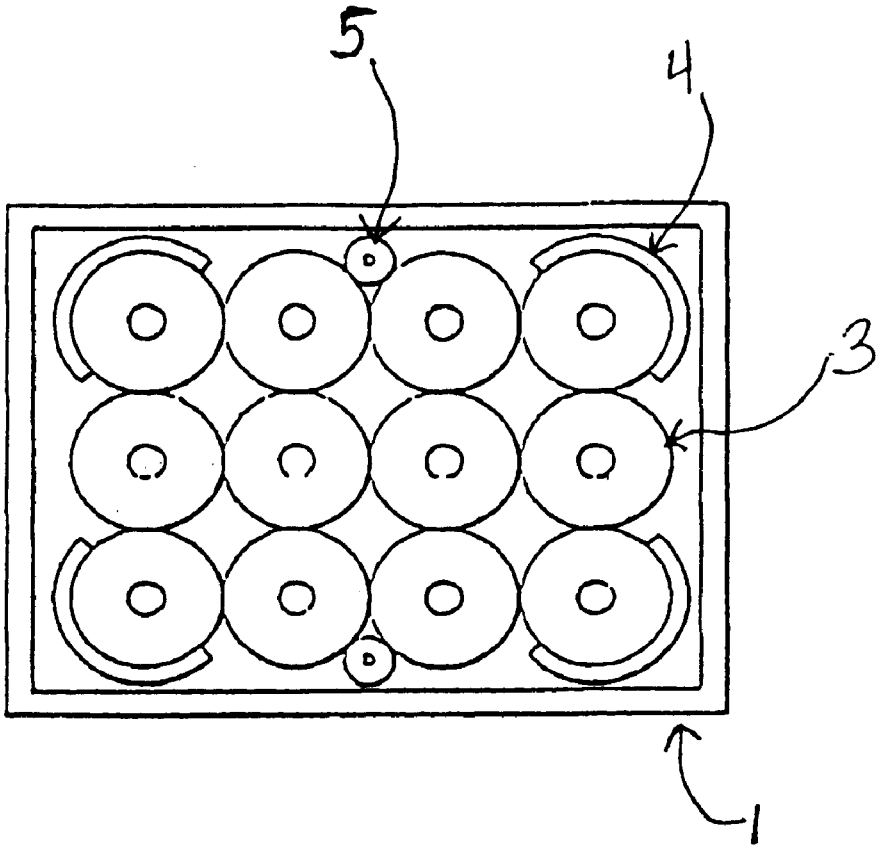
FIG. 5: is a top view of the invention with the top cap removed.

In a preferred embodiment additional protection is provided by at least one support post, or more preferably two support posts (5) vertically placed between two columns of stacked rovings located in the outside rows at opposite sides of the assembled rovings as shown in FIGS. 3, 4, and 5. In the preferred embodiment these support posts are also slightly taller in height than the height of a column of stacked rovings and ideally are approximately the same height as the curved panels (4). The support posts provide further protection against the possibility of damage to the material during storage or other handling. Furthermore, they can be made of relatively rigid or high compression strength materials similar to the curved panels (4) including plastic, pressed or corrugated board materials or other appropriate materials. Depending upon the material utilized, the support posts may be hollow to save weight. Additionally, the support posts may also be reused.

Ideally, the diameter of the support posts should be such that they approximately fit within the space defined by the outer circumference of two adjacent columns of stacked rovings and a line drawn tangentially between two adjacent columns of rovings at the point where the circumference of the rovings is closest to an exterior side of the package. It is acceptable, however, that a portion of the circumference of the support post extends beyond said tangentially drawn line. The package assembly preferably comprises at least two support posts that are located in the outside row on opposite sides of stacked rovings. Although the illustrated embodiment of the invention uses only two support posts, additional posts can be utilitzed if desired. Also, although the support posts shown in the illustrations are cylindrical, non-cylindrical support posts can be utilized.

Once the curved protective panel and support posts are properly positioned among the stacked rovings, a top cap or cover (6) is placed over the assembly to hold the panels and support posts in place while the entire assembly is wrapped with a stretch wrap material. The top cap also serves the additional function of protecting the material from contamination or other damage during storage or handling.

After the top cap is placed over the stacked rovings, panels and support posts, the entire assembly is secured with stretch wrap. This can be accomplised by machinery which rotates the palletized load while the stretch wrap material securely wraps the assembled load. The stretch wrap material or securing means for holding the assembled load draws the assembled rovings and protective panels together, and reduces the movement between the rovings, protective panels and support base.

Although applying a stretch wrap material to the palletized load is preferred, other acceptable methods of securing the load can be utilized. One benefit of stretch wrapping the load is that the material can be very securely wrapped thereby reducing the extent to which movement of the rovings occurs during shipping and other handling.

The combination of the shipping pallet or support base, plurality of generally cylindrical rovings stacked vertically upon the support base, the vertically stacked plurality of rovings having at least a first roving layer and a second roving layer defining a height and having outside comers, plurality of curved protective panels each of which approximately conforms to the exposed height of the vertically stacked plurality of rovings and being located at the outside comers of the vertically stacked plurality of rovings, and securing means for holding the support base, rovings and protective panels together provide a package assembly for shipment and in-storage handling of rovings of material.

The package assembly generally has the curved protective panels located at the outside comers of the vertically stacked plurality of rovings, with the location of the curved protective panel generally defined by the outside circumference of the vertically stacked plurality of rovings. The vertical layers of rovings may be stacked at various heights, from about two or more layers, preferably comprising at least a third vertical layer, more preferably at least a fourth rovings layer in height, and most preferably about four roving layers in height.

The roving layers of the package assembly may have the vertically stacked first roving layer and second roving layer in direct contact with each other, preferably with no interspersed barriers between the vertically stacked first roving layer and second roving layer. Other or additional adjacent vertically stacked roving layers may also be in direct contact with each other.

Additionally, the package assembly for shipment and in-storage handling of rovings of material may consist of a support base, a plurality of generally cylindrical rovings stacked vertically upon the support base, the vertically stacked plurality of rovings having from about one to about four roving layers defining a height and having outside comers, a plurality of curved protective panels each of which is longer in height than the height of the roving layers, wherein the protective panels approximately conform to the exposed height of the vertically stacked plurality of rovings and being located at the outside comers of the vertically stacked plurality of rovings, optionally, a top cap placed at the side of the vertically stacked plurality of rovings opposite the support base, and, securing means for holding the support base, rovings, protective panels together, wherein the top cap also is held by the securing means when the top cap is present. Preferably the top cap is present.

Although one preferred embodiment has been illustrated, this was for the purpose of describing, not limiting the invention. Various modifications, which will become apparent to one skilled in the art, are within the scope of the invention described in the attached claims.

What is claimed is:

1. A package assembly for shipment and in-storage handling of rovings of material comprising:

a. a support base;

b. a plurality of generally cylindrical rovings stacked vertically upon the support base, the vertically stacked plurality of rovings having at least a first roving layer and a second roving layer defining a height and having outside corners;

c. a plurality of curved approximately semi-cylindrical protective panels each of which is at least the height of two roving layers, wherein the protective panels approximately conform to the exposed height of the vertically stacked plurality of rovings and being located at the outside corners of the vertically stacked plurality of rovings; and, d. securing means for holding the support base, rovings and protective panels together.

2. The package assembly of claim 1, wherein the protective panels approximately conform to the outside circumference of the outside comers of the vertically stacked plurality of rovings.

3. The package assembly of claim 2, wherein the protective panels fit flush against the outside comers of the vertically stacked plurality of rovings.

4. The package assembly of claim 1, wherein the location of the curved protective panels located at the outside comers of the vertically stacked plurality of rovings is defined by the outside circumference of the vertically stacked plurality of rovings.

5. The package assembly of claim 1, wherein the protective panels are at least 1/16th inch taller than the height of the vertically stacked plurality of rovings.

6. The package assembly of claim 1, wherein at least the vertically stacked first roving layer and second roving layer are in direct contact with each other.

7. The package assembly of claim 1, wherein there are no interspersed barriers between the vertically stacked first roving layer and second roving layer.

8. The package assembly of claim 6, wherein additional adjacent vertically stacked roving layers are in direct contact with each other.

9. The package assembly of claim 1, wherein the vertically stacked plurality of rovings comprises a third roving layer.

10. The package assembly of claim 9, wherein the plurality of stacked roving comprises a fourth roving layer.

11. The package assembly of claim 1, wherein the protective panels are at least three rovings in height.

12. The package assembly of claim 11, wherein the protective panels are at least four rovings in height.

13. The package assembly of claim 1, further comprising at least one support post.

14. The package assembly of claim 13, comprising at least two support posts, the support posts being located in the outside row on opposite sides of stacked rovings.

15. The package assembly of claim 1, wherein the securing means for holding draws the assembled rovings and protective panels together reducing the movement between the rovings, protective panels and support base.

16. The package assembly of claim 1, wherein the securing means for holding comprises stretch wrap.

17. The package assembly of claim 1, further comprising a top cap.

18. A package assembly for shipment and in-storage handling of rovings of material consisting of:

a. a support base;

b. a plurality of generally cylindrical rovings stacked vertically upon the support base, the vertically stacked plurality of rovings having from about two to about four roving layers defining a height and having outside corners;

c. a plurality of curved approximately semi-cylindrical protective panels each of which approximately conforms to the exposed height of the vertically stacked plurality of rovings and being located at the outside corners of the vertically stacked plurality of rovings;

d. optionally, a top cap placed at the side of the vertically stacked plurality of rovings opposite the support base; and, e. securing means for holding the support base, rovings, protective panels together, wherein the top cap also is held by the securing means when the top cap is present.

19. The package assembly of claim 18, wherein the top cap is present.

* * * * *